US005173073A

United States Patent [19]

Franzone

[11] Patent Number: 5,173,073

[45] **Date of Patent: * Dec. 22, 1992**

[54] WHEELED SPARKPLUG TOY VEHICLE

[76] Inventor: Victor E. Franzone, 15 Berger St., Emmaus, Pa. 18049

[ * ] Notice: The portion of the term of this patent subsequent to Apr. 23, 2008 has been disclaimed.

[21] Appl. No.: 654,290

[22] Filed: Feb. 11, 1991

[51] Int. Cl.[5] ..... A63H 17/00; A63H 17/26

[52] U.S. Cl. ..... 446/465; 446/470; D21/128

[58] Field of Search ..... D21/128, 137, 136, 135, D21/134; D13/137; 446/23, 88, 87, 93, 95, 96, 431, 465, 466, 469, 470, 471, 491, 71, 77, 78

[56] References Cited

U.S. PATENT DOCUMENTS

| | | | |
|---|---|---|---|
| D. 316,436 | 4/1991 | Franzone | D21/128 |
| 2,190,800 | 2/1940 | Murphy | 434/373 X |
| 2,247,354 | 7/1941 | Berger | 446/437 |
| 2,770,915 | 11/1956 | Hicks | 446/78 X |
| 3,777,392 | 12/1973 | Span et al. | 446/78 |
| 3,883,983 | 5/1975 | Coster | 446/78 |
| 4,597,743 | 7/1986 | Becker et al. | 446/469 X |
| 4,963,115 | 10/1990 | Davin et al. | 446/88 X |

FOREIGN PATENT DOCUMENTS

| | | | |
|---|---|---|---|
| 2912337 | 10/1980 | Fed. Rep. of Germany | 446/71 |
| 430832 | 9/1948 | Italy | 446/95 |

*Primary Examiner*—D. Neal Muir
*Attorney, Agent, or Firm*—John J. Selko

[57] ABSTRACT

A wheeled toy vehicle includes a used electronic sparkplug for a body, a pair of front wheels attached to the contact terminal end of the sparkplug and a pair of rear wheels attached to the shank end of the sparkplug.

7 Claims, 2 Drawing Sheets

WHEELED SPARKPLUG TOY VEHICLE

FIELD OF THE INVENTION

This invention relates to wheeled toy vehicles for rolling by hand. It furthers relates to such vehicles which are made from electronic spark plugs of the type used in automobiles and trucks, such spark plugs being worn out and of no further effectiveness.

BACKGROUND OF THE INVENTION

It is well known that sparkplugs used in automobiles and trucks wear out periodically and must be replaced. Used sparkplugs are usually discarded, having no further economic value. This invention provides a product making further use of such sparkplugs by taking advantage of their overall streamlined appearance, to provide a toy with race-car appearance, using an authentic automotive part. The invention can also be used as a paperweight for adults in the businesses associated with sparkplugs.

SUMMARY OF THE INVENTION

I provide the above benefits by affixing to a sparkplug a first pair of spaced-apart parallel front wheels, and a second pair of spaced-apart rear wheels. The front wheels are affixed to the end of the sparkplug with the contact terminal and the rear wheels are affixed to the shank of the sparkplug. The front and rear wheels have axle-lines perpendicular to the longitudinal axis of the sparkplug. Alternative means for affixing the front and rear wheels to the sparkplug are disclosed.

DESCRIPTION OF PREFERRED EMBODIMENT AND BEST MODE

Figure 1:
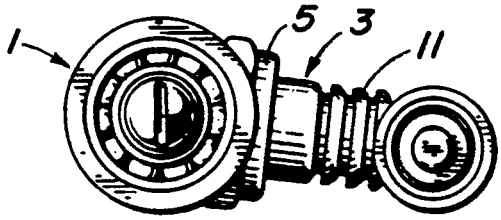
FIG. 1 is a side elevational perspective view of the toy vehicle of this invention.
Figure 2:
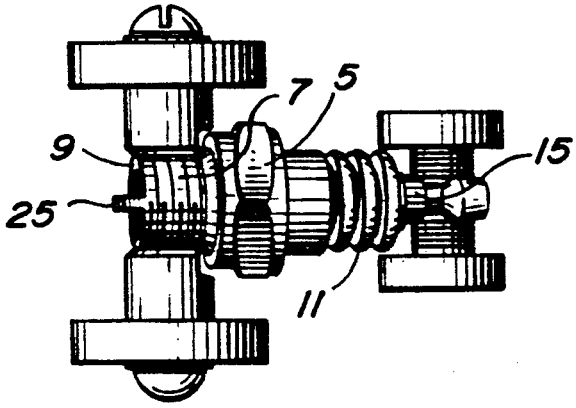
FIG. 2 is a top perspective plan view thereof.
Figure 3:
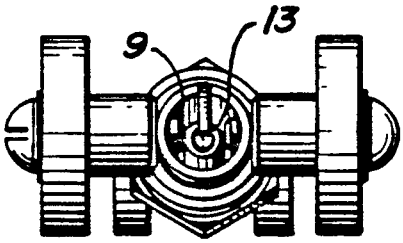
FIG. 3 is a rear perspective elevational view thereof.

Referring to FIGS. 1–3, one embodiment of a wheeled vehicle 1 is shown having a sparkplug body member 3. The sparkplug 3 can be on any conventional type and preferably one which is ready to be discarded, after use. Sparkplug 3 has a shell 5 terminating in a tubular threaded shank rear portion 7, said shank 7 being circular in cross section at rear terminal end 9, when viewed in elevation (as per FIG. 3). A porcelain core member 11, extends through shell 5. Core member 11 has a rear end 13 terminating adjacent the terminal end 9 of shank 7, and a front end 15 terminating outside of shell 5.

Figure 4:
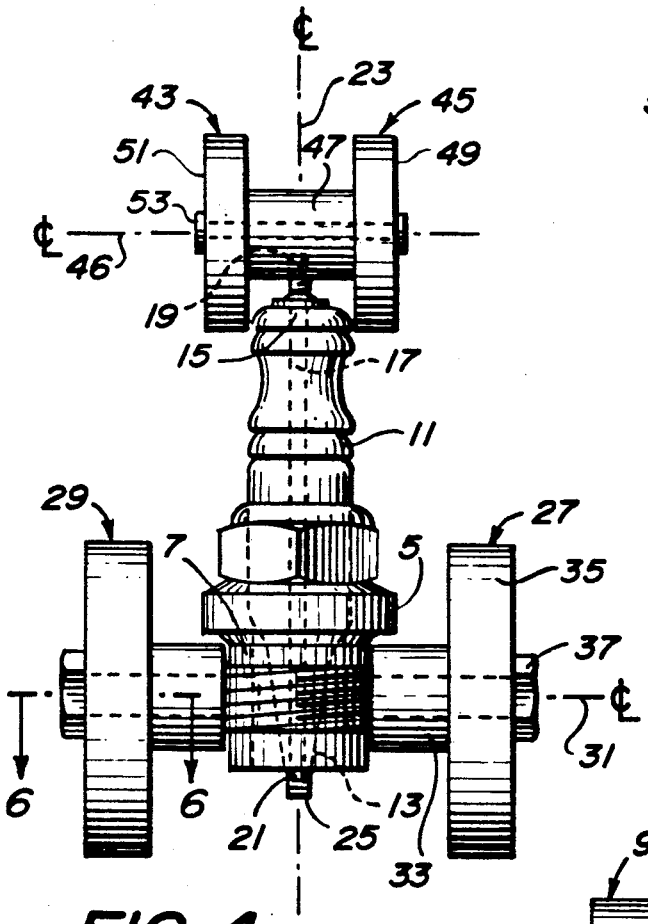
FIG. 4 is top plan view of the vehicle showing one embodiment of a pair of rear wheels and a pair of front wheels affixed to the sparkplug.

As shown in FIG. 4, a center electrode 17 extends length-wise through core member 11, terminating in a front end 19 adjacent front end 15 of core 11. Electrode 17 terminates in a rear end 21 adjacent rear end 13 of core 11. Longitudinal axis 23 for shell 5, shank 7, core 11 and electrode 17 coincides, and is hereafter referred to as the "longitudinal axis of the sparkplug." Shank 7 has a rear firing pin 25 positioned adjacent rear end 21 of electrode 17. The aforementioned elements are conventional parts of electronic sparkplugs, and are described herein for purposes of providing structure for mounting wheels, as described hereinafter. Other designs of sparkplugs or sparkplug-like members would suffice, so long as structure appearing similar to the electrode, core and tubular shank are included, and similarly positioned in longitudinal relationship to each other. The term "sparkplug" used herein includes such other designs.

Referring to FIG. 4, the preferred embodiment of rear wheel mounting is shown. A pair of parallel rear wheels 27 and 29, respectively, are shown affixed to shank 7. Wheels 27 and 29 are rotatable about rear axle-line 31 located on a diameter of circular tubular shank 7, when viewed in elevation, (as per FIGS. 3,7). Thus, axle-line 31 passes through longitudinal axis 23 of sparkplug 1.

Each wheel 27, 29 includes the same elements, and description of one rear wheel will be the same as for the other rear wheel. Wheel 27 includes hub member 33, rim member 35 rotatably affixed to hub member 33 and shaft 37 extending through hub member along axle-line 31. Shaft 37 is affixed to shank 7 by conventional means, such as threads, or press fit or welding. I prefer shaft 37 to be a machine screw or bolt, threaded into shank 37, making wheel 27 removable from shank 7. Also, the screw head or bolt head presents a finished appearance, (see FIGS. 1–3).

Figure 6:
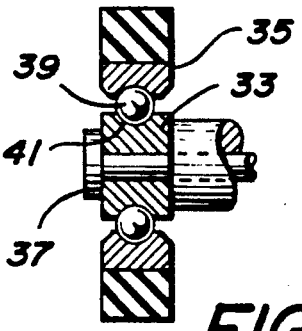
FIG. 6 is a cross sectional view of a rear wheel, along lines 6—6 of FIG. 4.

I prefer the wheels 27, 29 to be easily rotatable, about axle-line 31 as in a conventional ball bearing structure, shown in FIG. 6. Rim 35 rotates about hub 33 by means of roller bearings 39 moving in raceway 41. Rim 35 can be of any suitable material, but I prefer rubber for more authentic appearance. As show in FIG. 4, hub 33 contacts shank 7 and is of sufficient dimension along axle-line 31 to space wheel 27 away from shell 5 to avoid wheel contact with shell 5. As shown in FIGS. 1–3, hub 33 can be notched to permit wheels 27, 29 to be spaced close to shell 5, for pleasing proportionality. Ball bearing wheels 27, 29 are not mandatory, so long as any wheel is rotatable about axle-line 31 and spaced along axle-line 31, apart from, and not in contact with, shell 5, during rotation.

FIG. 4 shows a preferred embodiment for mounting a pair of spaced-apart parallel front wheels 43, 45 to a sparkplug having an electrode 17 with a threaded front end 19. Wheels 43, 45 include a hub 47 spaced between wheels 43, 45. A first rim member 49 of wheel 45 is rotatably affixed to one end of hub member 47. A second rim member 51 of wheel 43 is rotatably affixed to an opposite end of hub member 47. Hub member 47 can be a single solid member, but I prefer to permanently join two separate wheel and hub member assemblies, as described herein above for wheel 45, on shaft 53. Shaft 53 can be a rivet or other suitable joinder device. Threaded end 19 of electrode 17 is threaded into a suitable threaded aperture in hub member 47. The position of the aperture is equidistant between wheels 43, 45 and, when viewed in elevation, in the same plane as axle-line 46. This embodiment is preferred for sparkplugs having threaded ends 19 carrying a screwed on contact terminal (not shown) of size too small to permit a drill hole for shaft 53 to penetrate therethrough without intersecting electrode 17. Because electrode 17 is conventionally made from a very refractory and hard material, I have discovered that it is very difficult to drill through electrode 17 to provide an axle-line 46 passing through electrode 17. This embodiment places axle-line 46 and shaft 53 in advance of the front end 19 of electrode 17, thereby avoiding this difficulty.

Figure 5:
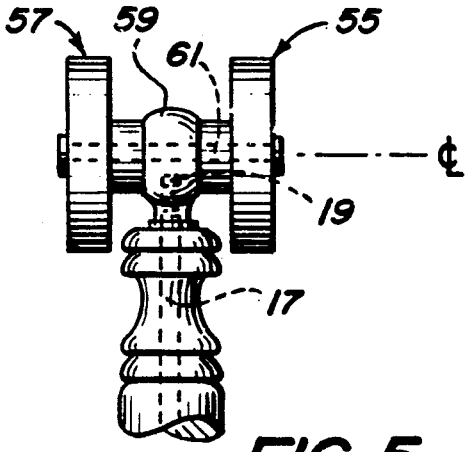
FIG. 5 is a top plan view, with parts removed, showing an alternate embodiment for affixing a pair of front wheels to a sparkplug.

FIG. 5 shows a preferred embodiment for mounting a pair of spaced-apart front wheels 55, 57 to a sparkplug having an electrode 17 with a contact terminal 59 of sufficient size to permit an axle 61 to pass therethrough without intersecting electrode 17. Therefore, if contact terminal 59 is large enough, axle 61 should extend through terminal 59 in advance of the front end 19, of electrode 17, as viewed in plan, FIG. 5. If contact terminal 59 is too small to permit such axle location, wheels 43, 45 should be mounted as described hereinabove with FIG. 4.

Figure 7:
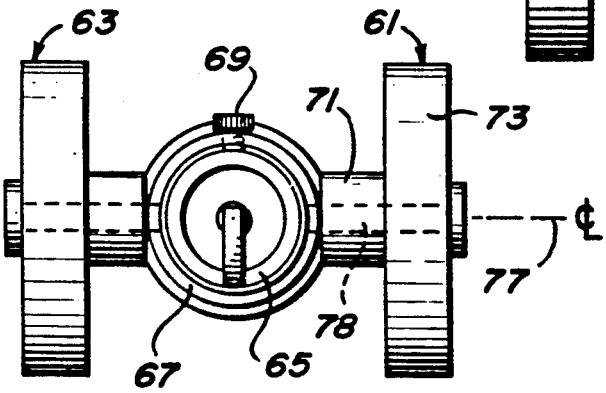
FIG. 7 is a rear elevational view showing an alternate embodiment for affixing the pair of rear wheels to a spark plug.

FIG. 7 shows an elevational view of an alternate embodiment for affixing a pair of spaced-apart, parallel rear wheels 61, 63 to a shank 65. A collar 67 of suitable material, preferably metal, circumferentially spans shank 65. Collar 67 is held against shank 65 by screw 69 threaded therethrough into contact with shank 65. Screw 69 can be countersunk for better appearance.

Each wheel 61, 63 is the same, and a description of one wheel will suffice for both. Wheel 61 has first hub member 71 for spacing wheel 61 from collar 67. Rim member 73 is rotatably mounted on hub 71 as described for wheel 27. Axle 75 extends through hub member 71 along rear axle-line 77 and is fastened to collar 67, as by threaded joinder. Axle 75 may or may not extend through collar 67 to contact shank 65. The longitudinal axis (not shown) of collar 67 coincides with the longitudinal axis of sparkplug 3. Axle-line 77 is perpendicular to the longitudinal axis of the sparkplug, and is in the same plane thereof, when viewed in elevation.

Figure 8:
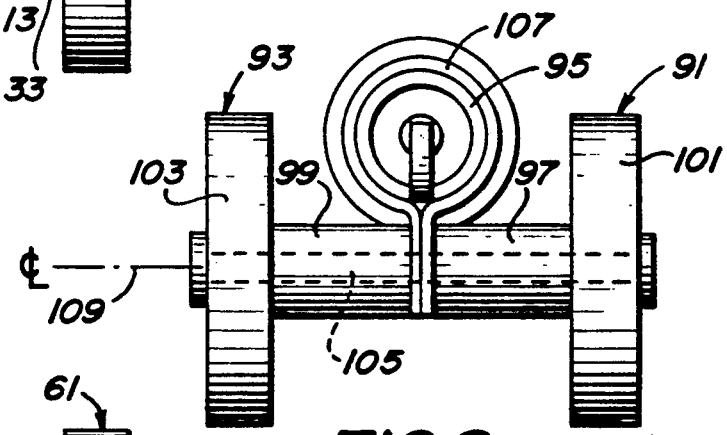
FIG. 8 is a rear elevation of view of a second alternate embodiment for affixing a pair of rear wheels to a spark plug.

FIG. 8 shows an elevational view of a second alternative embodiment for affixing a pair of spaced apart, parallel wheels 91, 93 to shank 95. Each wheel 91, 93 includes, respectively, hub 97, 99 and rim 101, 103 assemblies rotatably mounted as described hereinabove for wheel 27. Hubs 97, 99 extend sideways of their respective rims, 101, 103 along axle 105, so as to space wheels 91, 93 apart to avoid contact with any part of the sparkplug. A thin strip of metal formed into a saddle 107 is connected to axle 105 between hub 97, 99. Saddle 107 forms an aperture which is circular in cross section, as viewed in elevation, similar to shank 95. Saddle 107 circumferentially spans shank 95. The aperture of saddle 107 is of sufficient diameter to force-fit (friction-fit) circumferentially around shank 95. The aperture of saddle 107 has a center point and longitudinal axis which coincides with the longitudinal axis of the sparkplug. Rear axle-line 109 extends perpendicular to the longitudinal axis of the sparkplug. Axle-line 109, is positioned in a plane below the plane of the longitudinal axis of the sparkplug, when viewed in elevation, but parallel to a front axle line, when viewed in plan, as described hereinabove.

The alternate embodiments herein can also be used to mount the front pair of spaced-apart parallel wheels. In such case, the collar 67 would circumferentially span the front end 19 of core 11 and be affixed thereto. Likewise, the saddle 95 would circumferentially span core member 11, and be friction-fit thereon. The spacing apart of front wheels would be adjusted to avoid contact with the sparkplug.

Generally, in order to provide a streamlined appearance to the vehicle, the spacing apart of the front wheels is preferred to be less than the spacing apart of the rear wheels, but equal spacing could be used. Likewise I prefer the diameter of front wheels to be smaller than the diameter of rear wheels.

I claim:

1. A wheeled toy vehicle comprising:
   a. a sparkplug, having a longitudinal axis, a tubular threaded shank rear end and a center electrode, said center electrode having a contact terminal front end;
   b. means for affixing a pair of spaced-apart, parallel rear wheels to said shank, said wheels being rotatable about a rear axle-line perpendicular to said longitudinal axis; and affixing a pair of spaced-apart, parallel
   c. means for affixing a pair of spaced-apart, parallel front wheels to said contact terminal, said wheels being rotatable about a front axle-line perpendicular to said longitudinal axis; and
   d. said rear axle-line and said front axle-line being parallel, when viewed in plan.

2. The invention of claim 1 in which each wheel of said pair of rear wheels includes:
   a. a hub member for spacing said wheel from said shank;
   b. a rim member rotatably affixed to said hub member; and
   c. means extending through said hub member along said axle-line, for fastening said hub member to said shank.

3. The invention of claim 2 in which said pair of front wheels includes:
   a. an axle extending through said contact terminal;
   b. a first wheel rotatably mounted on said axle adjacent one side of said contact terminal; and
   c. a second wheel rotatably mounted on said axle adjacent an opposite side of said contact terminal from said first wheel.

4. The invention of claim 2 in which said pair of front wheels includes;
   a. a hub member spaced between a first and second wheel;
   b. a first rim member of said first wheel rotatably affixed to one end of said hub member;
   c. a second rim member of said second wheel rotatably affixed to an opposite end of said hub member; and
   d. means for attaching said hub member to a front end of said electrode, equal distant between said first and second wheels.

5. The invention of claim 1 in which said pair of rear wheels includes;
   a. a collar circumferentially spanning said shank;
   b. means for fastening said collar to said shank;
   c. a first hub member for spacing a first wheel from said collar;
   d. a first rim member rotatably affixed to said first hub member;
   e. means extending through said first hub member along said rear axle-line for fastening said first hub member to said collar;

f. a second hub member for spacing a second wheel from said collar;

g. a second rim member rotatably affixed to said second hub member; and h. means extending through said second hub member along said rear axle-line for fastening said second hub member to said collar on a side of said shank opposite said first wheel.

6. The invention of claim 2 in which said pair of rear wheels includes:

a. a first hub member for spacing a first wheel from said shank;

b. a first rim member rotatably affixed to said first hub member;

c. a second hub member for spacing a second wheel from said shank;

d. a second rim member rotatably affixed to said second hub member;

e. said first and second hub member extending toward each other along an axle;

f. a saddle connected to said axle between said first and second hub members, said saddle forming an aperture circular in cross section when viewed in elevation said saddle circumferentially spanning said shank and being friction-fit thereon; and g. said axle having an axle-line positioned below said longitudinal axis of said sparkplug, when viewed in elevation.

7. A wheeled toy vehicle comprising:

a. a sparkplug body having:

(i) a shell terminating in a tubular threaded shank rear portion, said shank being circular in cross section at a terminal end, when viewed in elevation;

(ii) a core member extending through said shell, said core having a rear end terminating adjacent the terminal end of said shank and a front end terminating outside of said shell;

(iii) a center electrode extending through said core terminating in a front end adjacent said front end of said core and a rear end adjacent the rear end of said core, said electrode, said core and said shell having substantially the same longitudinal axis; and (iv) a contact terminal on the front end of said electrode;

b. a pair of rear wheels affixed to said shank, said wheels rotatable about an axle-line located on a diameter of said circular shank, when viewed in elevation, each wheel including:

(i) a hub member;

(ii) a rim member rotatably affixed to said hub member; and (iii) a shaft extending through said hub member along said axle-line, said shaft attached to said shank; and c. a pair of front wheels affixed to said contact terminal, said wheels rotatable about a shaft extending on an axle-line parallel to the axle-line of rear wheels, when viewed in plan.

* * * * *